United States Patent [19]

Listl et al.

[11] Patent Number: 4,786,806

[45] Date of Patent: Nov. 22, 1988

[54] RETARDING FIELD SPECTROMETER

[75] Inventors: Carl A. Listl, New Hyde Park, N.Y.; Henry Seiwatz, Wayne, N.J.

[73] Assignee: GAF Corporation, Wayne, N.J.

[21] Appl. No.: 64,491

[22] Filed: Jun. 22, 1987

[51] Int. Cl.[4] ..... H01J 49/44; H01J 39/00

[52] U.S. Cl. ..... 250/305; 250/347; 250/310

[58] Field of Search ..... 250/305, 310, 306, 307, 250/396 ML, 396 R, 397, 399

[56] References Cited

U.S. PATENT DOCUMENTS

| | | | |
|---|---|---|---|
| 3,681,600 | 8/1972 | Rigden et al. | 250/305 |
| 4,227,087 | 10/1980 | Kruz | 250/397 |
| 4,540,885 | 9/1985 | Plies et al. | 250/310 |
| 4,658,137 | 4/1987 | Garth et al. | 250/310 |
| 4,721,910 | 1/1988 | Bokor et al. | 324/158 R |

FOREIGN PATENT DOCUMENTS

| | | | |
|---|---|---|---|
| 0058587 | 5/1972 | Japan | 250/305 |

*Primary Examiner*—Bruce C. Anderson
*Assistant Examiner*—Paul A. Guss
*Attorney, Agent, or Firm*—Marilyn J. Maue; Joshua J. Ward

[57] ABSTRACT

A retarding field spectrometer has a mounting ring for attachment to the pole piece of a scanning electron microscope or similar beam generator. Supported by the mounting ring are three screen electrodes with their planes positioned normal to the beam axis and adjustable as a unit in a pseudo-orthogonal manner through two worm and gear drives of eccentrics cooperating with an aperture and a slot, respectively, in a plate carrying the electrode closest to the pole piece. Three continuous dynode electron multipliers are arrayed symmetrically about the beam at-rest axis between the last mentioned electrode and the intermediate electrode. The multipliers have cathodes maintained at substantially the same potential as the intermediate electrode. The electrode furthest from the pole piece is suspended from a mounting ring for the intermediate electrode by means of criss-crossing strands of a continuous plastic monofilament permitting orthogonal adjustment of the furthest electrode relative to the intermediate electrode while insulating electrically one from the other.

22 Claims, 4 Drawing Sheets

RETARDING FIELD SPECTROMETER

The United States Government has rights in this invention pursuant to Contract No. F 33615-81-C-1567 awarded by the Department of the Air Force.

BACKGROUND OF THE PRESENT INVENTION

The present invention relates to a retarding field spectrometer and, more particularly, to a spectrometer for use with a scanning electron microscope (SEM) or the like.

Considerable literature exists describing the use of scanning electron microscopes for topographical voltage and waveform determinations over the surface of an integrated circuit. One such article by H. P. Feuerbaum entitled "VLSI Testing Using the Electron Probe" was published in Scanning Electron Microscopy/1979/I, SEM Inc., AMF O'Hare, Ill. 60666, 285–296, 318. As noted in the "Abstract" at the beginning of said article, the electron beam probe is an extraordinarily valuable aid for the developer of VLSI circuits because its almost negligible load, non-destructive operation and easy positioning allows the measurement of voltage at any desired point of an integrated circuit. However, the article observes that the measurement of voltages in the sampling mode on a 64 k MOS-RAM requires a reduction of the beam diameter to 1.2 micrometers (2.5 kV, $10^{-7}$ A) and an improvement of the voltage resolution to below the 10 mV mark. In order to accomplish such improvement the article explains that a retarding field spectrometer, developed for the purpose, and having a height permitting a working distance of 5 mm, should be used. The author describes an experimental set-up in which the beam is generated by the electron microscope column of an ETEC AUTOSCAN SEM. The spectrometer assembly includes an extraction electrode in the form of a screen maintained at 600V. This electrode is mounted about 1.1 mm above the target or sample surface oriented with its plane normal to the beam axis. Approximately 4 mm above the extraction electrode is mounted a retarding field electrode maintained at zero potential. Approximately 4.6 mm above the latter electrode is a further electrode maintained at −5V and this is spaced about 0.5 mm below the recessed pole piece of the microscope column. To one side of the space between the last two mentioned electrodes is a deflection field electrode maintained at 120V. In the overall system, the target is scanned by a pulsed primary beam and the secondary electrons having sufficient energy to get by the retarding field electrode are accelerated laterally to impinge upon a scintillator photomultiplier whose output is amplified and ultimately supplied to an oscilloscope.

In general, the article explains that present IC's have metal lines that are 4 micrometers wide, and to measure the voltage on the same the beam diameter should not exceed 1.2 micrometers. However, the article observes that circuits with much narrower lines are in development and that a future width of 1 micrometer is to be expected. But to measure the voltage on such lines the beam diameter will have to be reduced to about 0.3 micrometers. The article speculates that this can be accomplished by replacing the existing beam source with "an $LaB_6$ or field emission gun."

In the application of David Fairhurst Lewis entitled: "A Memory Element for Information Storage and Retrieval System and Associated Method," Ser. No. 047,350, filed May 8, 1987, and assigned to the same assignee as the present invention, there is described a recording medium that is used as a memory element on which information is written and read through irradiation with an electron beam. The invention disclosed and claimed in said application enables addresses to be located in the memory element with sufficient precision that in excess of $10^8$ bits/cm$^2$ can be recorded and retrieved. As explained in the Lewis application, to achieve such density the writing beam must be positionable and re-positionable with an accuracy in the neighborhood of about 0.1 micrometers. In addition, said application describes examples establishing that information can be recorded at a density on the order of $10^9$ bits/cm$^2$.

While the recording medium described and claimed in said Lewis application provides for addressing recording areas with the precision necessary for such high density recording, making maximum use of such recording medium requires significantly more sensitive beam writing and reading equipment than that heretofore available. In particular, where writing is accomplished by depositing a charge pattern on an insulating substrate, high resolution reading requires the ability to precisely direct the reading beam onto the medium and accurately detect returning secondary electrons while discriminating as to the energies of such secondaries. Sensitive beam writing is also important, and while the present invention is able to provide for the necessary sensitivity, sensitive beam writing can be enhanced by employing the procedure disclosed in the U.S. patent application Ser. No. 787,946 of Henry Seiwatz, filed Oct. 16, 1985 and entitled "Reduction of Deflection Errors in E-Beam Recording".

SUMMARY OF THE INVENTION

With the foregoing as background, it is an object of the present invention to provide a scanning electron beam apparatus for use in a memory medium recording and/or reading system which apparatus is characterized by high collection efficiency, small primary beam diameter, and good secondary electron energy discrimination.

Another object of the present invention is to provide a unique retarding field spectrometer for use with a modulatable and deflectable electron beam generator which spectrometer is particularly suitable for operation with primary beam diameters less than 0.50 micrometers.

Yet another object of the present invention is to provide a retarding field spectrometer having versatile adjustment capability to enable accurate alignment with the electron beam undeflected primary beam axis, i.e., at-rest axis, notwithstanding any deviation of the at-rest axis from the mechanical axis of the beam generator.

In accordance with one aspect of the present invention there is provided a retarding field spectrometer for use with a modulatable and deflectable electron beam generator which generator has a pole piece with an orifice from which said beam emanates, said spectrometer comprising in combination an array of three electrodes joined for mounting in the path of said beam between said pole piece and a target holder, means for individually energizing each of said electrodes with a discrete biasing voltage, means for applying a reference potential to said target, and at least one continuous dynode electron multiplier detector of secondary electron emission disposed with its cathode entryway positioned between those two of said electrodes that are situated nearest to said pole piece.

BRIEF DESCRIPTION OF THE DRAWINGS

The invention will be better understood after reading the following detailed description of the presently preferred embodiment thereof with reference to the appended drawings in which.

The same reference numerals are used throughout the drawings to designate the same or similar parts.

DETAILED DESCRIPTION OF THE PRESENTLY PREFERRED EMBODIMENT

Figure 1:
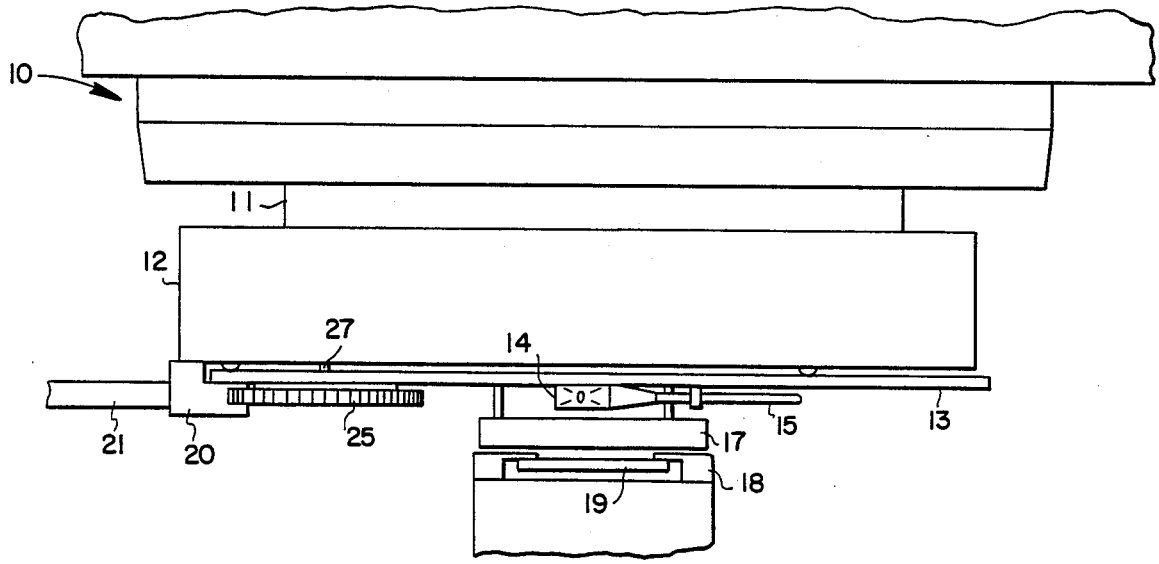
FIG. 1 is an elevational view, somewhat diagrammatic, showing the beam outlet end of a scanning beam generating column to which is assembled a retarding field spectrometer embodying the present invention and in operative relationship relative to a target or specimen holder.

Referring to FIG. 1, the beam outlet end of an electron beam generator such as that incorporated in a scanning electron microscope is designated generally by the reference numeral 10. The structure 10, shown only fragmentarily, is part of a complete beam generating, accelerating and scanning column enclosed within an evacuable housing, not shown. The details of construction of the scanning electron microscope are not included since the invention does not depend upon such specifics but is applicable to any modulatable and deflectable electron beam generator, and such generators are well known.

To the pole piece 11 (see FIGS. 1 and 2) there is attached the spectrometer of the present invention consisting of a mounting ring or collar 12 from which is suspended a mounting plate 13 from which, in turn, is suspended an array of continuous dynode electron multiplier detectors 14, 15 and 16 (see FIG. 4) and an electrode support 17. The electrode support 17 is located immediately above the target holder 18 for mounting a target 19.

The mounting plate 13 is coupled to the mounting ring 12 by retainers, such as the one at 20 seen in FIG. 1, free for adjustable positioning within its own plane. The plate 13 is adjusted by selectably rotating two shafts 21 and 22 (see FIGS. 1, 4 and 5) to the ends of which are fastened corresponding worm gears 23 and 24 which gears mesh with respective worm wheels or gears 25 and 26 mounted on respective shafts 27 and 28, each journaled in the collar 12.

Figure 4:
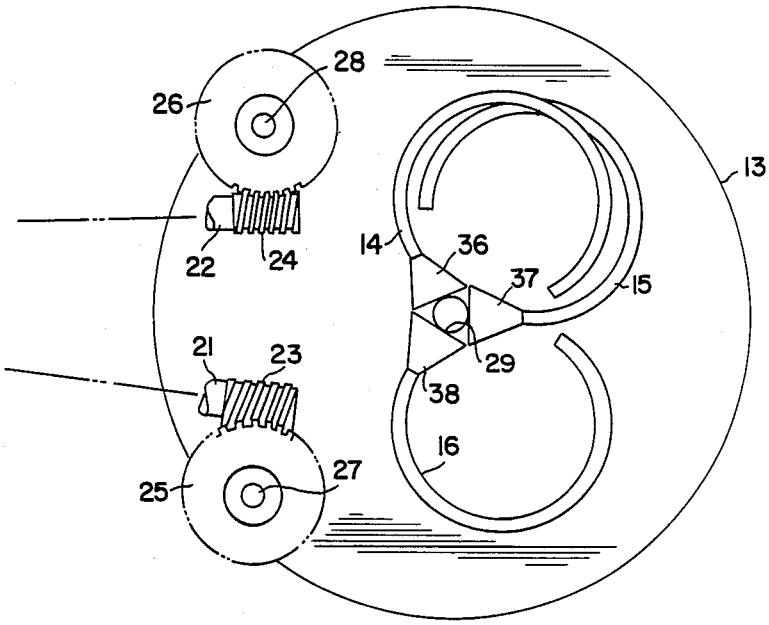
FIG. 4 is a sectional view taken along line 4—4 in FIG. 2 with certain components omitted for clarity.
Figure 5:
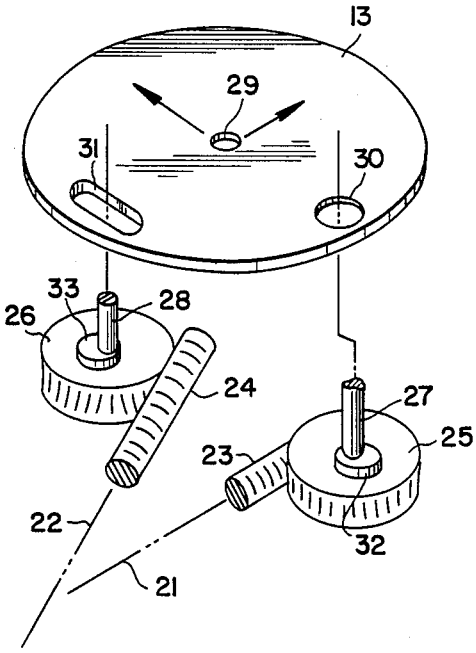
FIG. 5 is a diagrammatic perspective of one of the adjustment mechanisms employed in the spectrometer of FIG. 1.

The worm drives are best seen in FIGS. 4 and 5 from which it will be observed that the mounting plate 13 has a central aperture 29 and two additional apertures 30 and 31 therethrough located, each at a distance from the central aperture 29, approximately 90° apart about central aperture 29. One of the two additional apertures, namely 30, is circular, as shown, while the other is in the form of a slot 31. Each of the gears 25 and 26 is provided with an eccentric 32 and 33, respectively, which eccentrics engage respectively in the two additional apertures 30 and 31 such that rotation of the eccentric engaging the circular aperture 30 moves the central aperture 29 along a path paralleling the slotted aperture 31 while rotation of the other eccentric 33 moves the central aperture 29 in an arc centered about the circular aperture 30. The motion that can be imparted to the plate 13 and thus to the central aperture 29 can be recognized as approximately orthogonal. That is, the worm and gear driven eccentrics 32 and 33 provide for movement of plate 13 in a pseudo-orthogonal manner.

The continuous dynode electron multipliers 14 to 16, in this embodiment, are all identical and consist each of a channeltron, manufactured by Galileo Electro-Optics Inc., having a horn cathode, 36, 37 and 38, respectively, at its entryway which horn is positioned between the mounting plate 13 and the electrode support 17. The horns are positioned as best seen in FIGS. 2 and 4 with their mouths directed toward the at-rest axis of the electron beam, that is, the non-deflected position of the primary beam represented by the phantom line 34.

Figure 2:
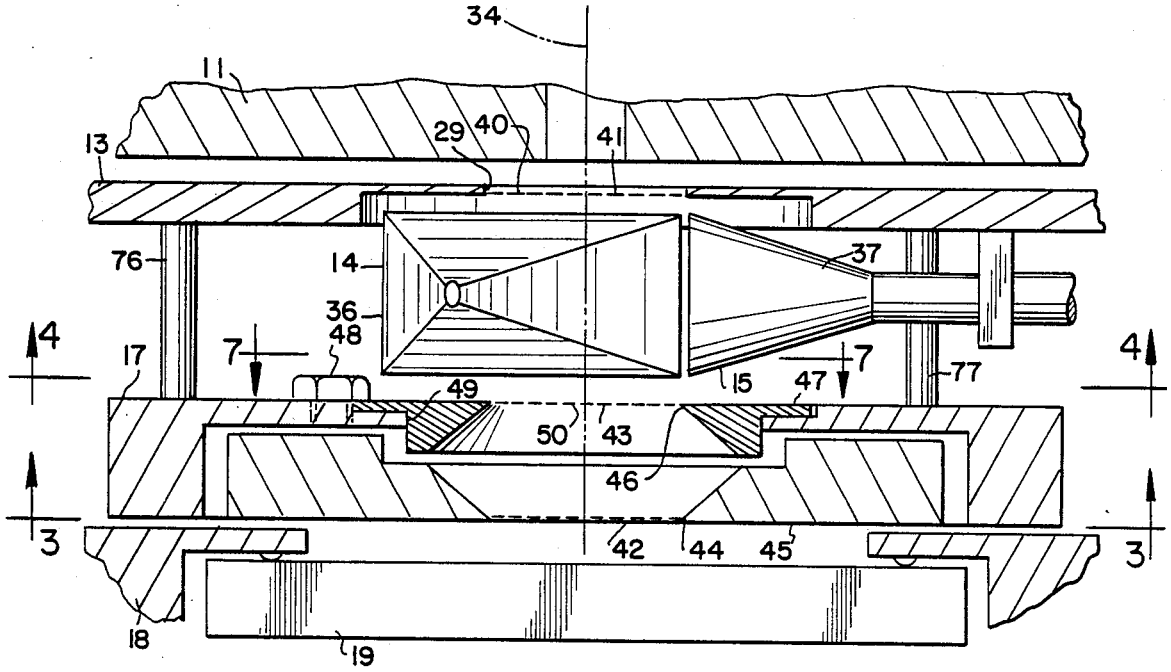
FIG. 2 is an enlarged vertical sectional view through the central portion of the spectrometer structure of FIG. 1.

As best seen in FIG. 2, the central aperture 29 in mounting plate 13 has stretched thereacross a fine mesh screen 40 fabricated from 100 mesh electro-formed copper screening. The screen 40 is soft-soldered to the plate 13 around the perimeter of the aperture 29. The aperture 29 has, for example, a diameter of 0.3" and the mesh 40 is provided with an opening 41 at its center 0.03"×0.03", and this can be produced by spark machining, after which the screen is gold flashed. The fine mesh screen 40 may be thought of as defining an array of small apertures with a central aperture (the opening 41) larger in area than any of the small apertures. In addition, the opening 41 is slightly larger in area than the area at the plane of mesh 40 that is traversed by the electron beam when the latter is deflected. The plate 13 supports the mesh 40 in a position substantially normal to the beam at-rest axis 34. It should be apparent that the mesh 40 is position-adjustable in its plane by moving plate 13 with the eccentrics 32 and 33 under control of worm drives 23 and 24, and this adjustment is used in the manner that will be explained below.

The electrode support 17 serves to mount two further fine mesh screen electrodes, 42 and 43, supporting electrodes 42 and 43 in the path of the electron beam, with their respective planes normal to the beam at-rest axis 34, between screen electrode 40 and the target 19. The screen electrode 42 is arranged to operate as a collector grid and is mounted across an aperture 44 in a support member 45. The support member is suspended in a manner to be described which enables the screen 42 to be adjusted orthogonally for the purpose of centering one of its meshes about the beam at-rest axis 34.

Figure 7:
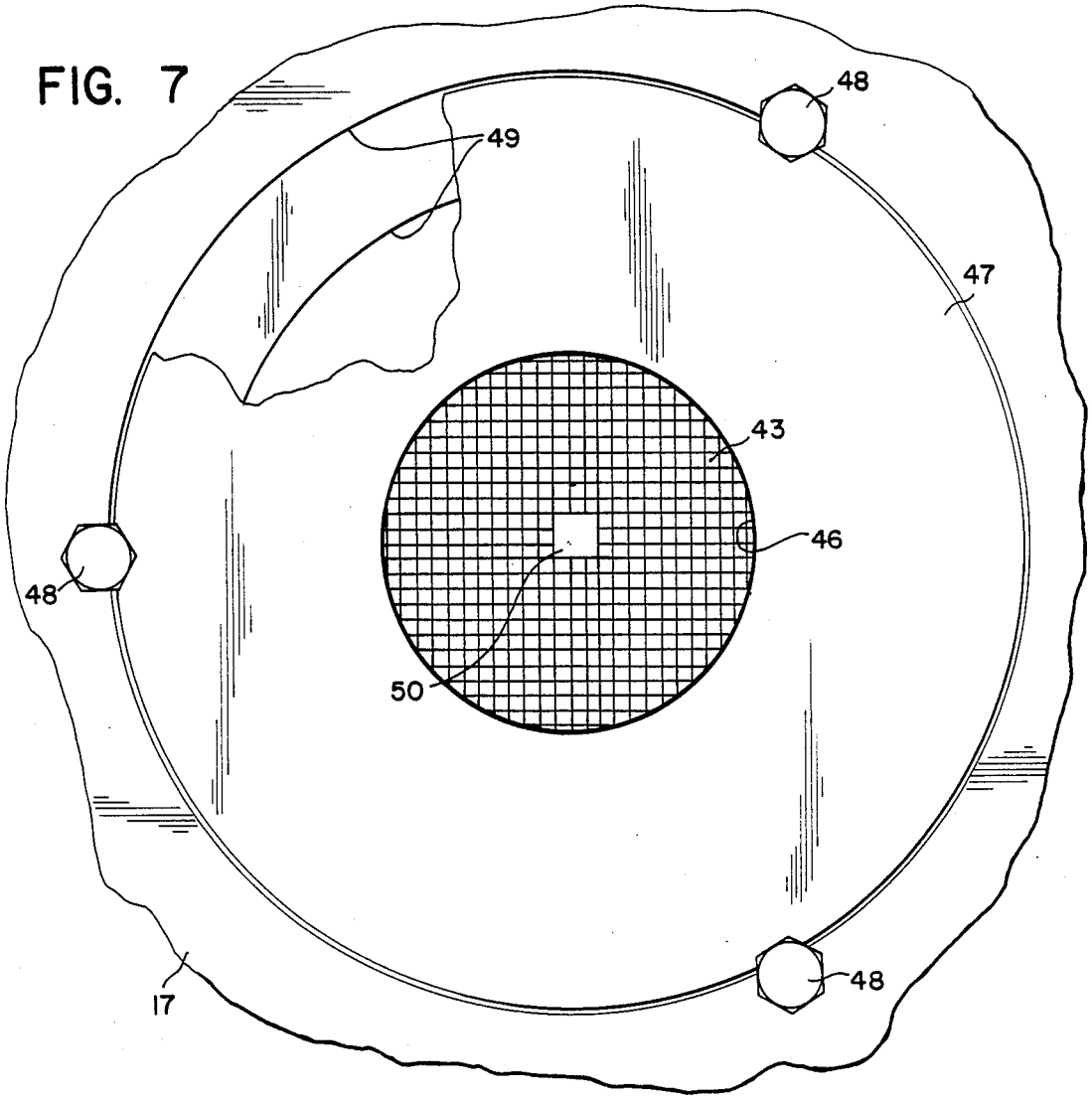
FIG. 7 is a sectional view, with portions partially broken away, taken along line 7—7 in FIG. 2.

The screen 43 is mounted across the aperture 46 in a ring or disc 47 which, in turn, is secured by screws 48 to the support 17. This is best seen in FIGS. 2 and 7. The disc 47 has a circular perimeter and is adjustably rotatable within the complementary aperture 49 in support 17 when the screws 48 are loosened. Both screens 42 and 43 may be of the same gold flashed 100 mesh electro-formed copper construction as screen 40. The screen 43 is intended to operate as a discriminator grid and, like screen 40, has a central aperture 50, 0.03"×0.03," that is larger in area than any of its individual meshes. The rotational adjustment of disc 47 permits the central aperture 50, which is rectilinear in shape, to be oriented with its sides parallel to the sides of the rectilinear mesh openings in screen 42. The screen 42, unlike screens 40 and 43, is left intact without an enlarged central opening.

As best seen in FIG. 2, the apertures 44 and 46 are bounded by walls that are conically configured diverging radially in the axial direction toward the opposite support member. The conical or tapered walls are chosen in an endeavor to obtain a substantially uniform field throughout the space between the screens or grids 42 and 43.

Figure 3:
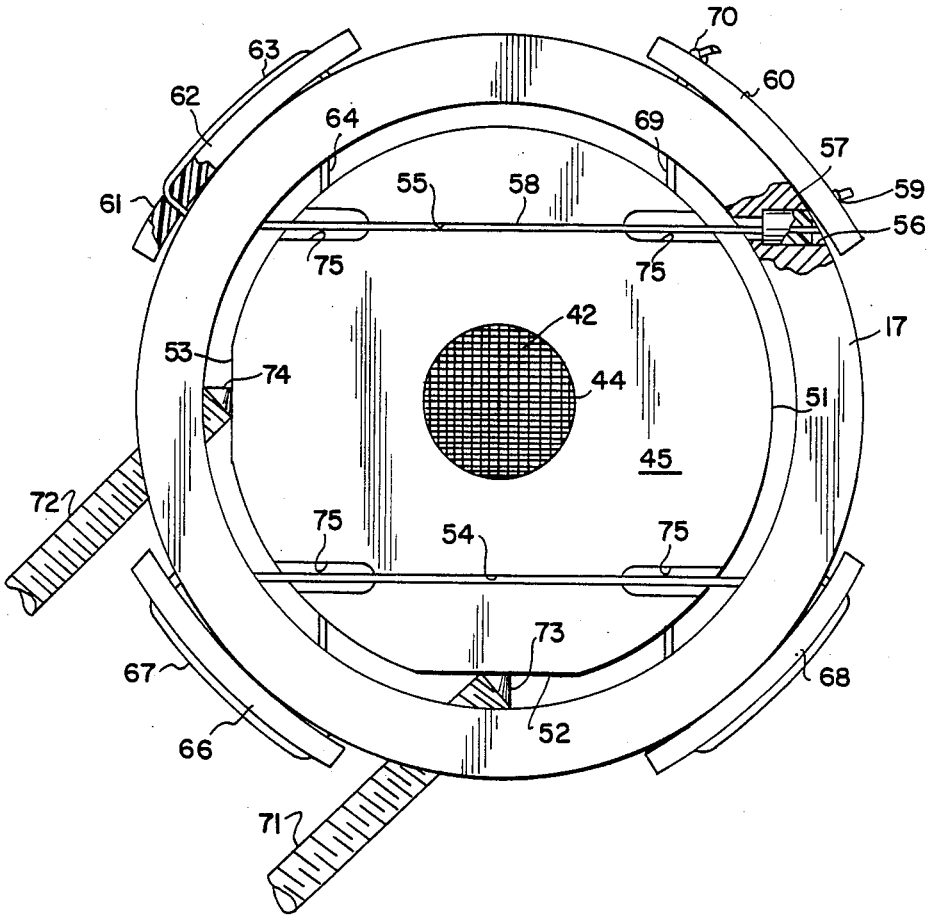
FIG. 3 is a transverse sectional view, with portions partially broken away, taken along line 3—3 in FIG. 2.

Referring to FIG. 3, it will be seen that support member 45 is generally disc shape with a circular cylindrical perimeter 51 except for two orthogonally related flats 52 and 53. Two parallel slots 54 and 55 are formed in the support member 45 along chords thereof equidistant from the aperture 44 and extending about half way through the thickness of the member 45. While not seen in FIG. 3, two similar slots are provided, as viewed in FIG. 3, on the rear face of member 45, except that the last mentioned slots are oriented orthogonally with respect to the slots 54 and 55.

With the member 45 positioned within support 17 as shown in FIG. 3, the chordal slots are in alignment with bores extending through the support 17, one of which is shown at 56, which bores are fitted with bushings such as the brass bushing 57. A continuous monofilament such as Nylon monofilament 58 is strung from a knotted end at 59, through a strain relief and tension bar 60, through bushing 57 passing through slot 55 and out through the corresponding bore in support 17 to pass through aperture 61 in another strain relief bar 62. The monofilament now extends at 63 behind bar 62 toward its opposite end whereupon it returns through another aperture in bar 62 and through a bore in support 17 passing at 64 into one of the underside slots in support member 45 to exit at 65 where it passes through member 17 and out through another strain relief bar 66 to extend around back at 67 and then returning through member 17 into slot 54. From there its path can be traced out and around back of a strain relief bar 68 into and through the second underslot to emerge at 69 and pass through support 17 and bar 60 to terminate in knot 70.

Two Nylon screws 71 and 72 with 45° coned tips 73 and 74 are threaded through support 17 to bear against, respectively, flats 52 and 53. It should now be apparent that the plastic filament support for member 45 in conjunction with the screws 71 and 72 provide an electrically insulated mounting for screen 42, isolating screen 42 from screen 43. It also should be observed that the slots 54 and 55, while fitting closely the monofilament 58 at the slot midsection, are widened at each end 75. The same widening is provided for the underside slots. With the described construction the disc 45 can translate along orthogonal axes normal to the flats 52 and 53, such translation being accompanied by bowing of the line 58 over the sections passing at right angles to the direction of movement. The widened slots facilitate this "bowing" while the additional tensioning of the line 58 is accommodated by the strain relief members 60, 62, 66 and 68, formed of a suitable plastic, e.g., Delrin, bending to conform more closely to the perimeter of support 17.. The bushings 57 provide a close tolerance fit and guide for the monofilament 58 to restrict its lateral movement and accurately position the same. The openings 61 in the strain relief members are flared to eliminate sharp corners and to avoid small radius bends in the monofilament 58. The elastic restoration of line 58 under the elastic tensioning afforded by bars 60, 62, 66 and 68 provides the spring return of disc 45 when the adjustment screw 71 or 72 is backed off. Of course advancing the screw 71 or 72 imparts the corresponding movement to member 45.

As best seen in FIG. 2, the support 17, carrying screens 42 and 43, is maintained parallel in fixed spaced relation to plate 13 by Delrin spacers, such as 76 and 77, through which pass Nylon screws (not shown) securing the parts together. At assembly, the openings 41 and 50 in screens 40 and 43 are aligned on a common axis.

In an embodiment of the invention that has been tested successfully, the plate 13 was formed from 0.063" thick stainless steel and was mounted on a ring 12 spaced therefrom by Teflon TFE glides. These glides can be fabricated from other insulating low friction materials such as Nylon, or the like. The plate 13 was electrically insulated from the ring 12 and arranged, when the ring 12 was secured to the pole piece 11, to be positioned parallel to but spaced 0.02" below the face of the pole piece. This permits up to 2000 volts to be applied between the plate 13 and the pole piece 11 without potential breakdown.

The worm gear drive for translating plate 13 was able to impart ±0.05" movement in each of two orthogonal directions. Also, the shafts 21 and 22 were angled toward each other such that they could be engaged alternatively by an adjustment rod mounted in an air lock in the side wall of the beam generator housing. This enables the entire retarding field structure to be translated along essentially orthogonal axes for initially aligning the center opening 50 of electrode 43 about the beam at-rest axis 34. The opening 41 in screen 40 will in all likelihood not be centered, but its offset will be tolerable.

When setting up the spectrometer, the next step is to center a mesh opening of screen 42 about the beam axis 34. This is accomplished by a trial and error procedure with screws 71 and 72 (See FIG. 3). For this purpose the vacuum chamber has to be vented before each adjustment and then re-evacuated, but the adjustment need not be made frequently. Once accomplished, it is sufficient to adjust plate 13, moving simultaneously all three screen electrodes to ensure that screen 42 is aligned. The slight misalignment of screens 40 and 43 can be tolerated.

Figure 6:
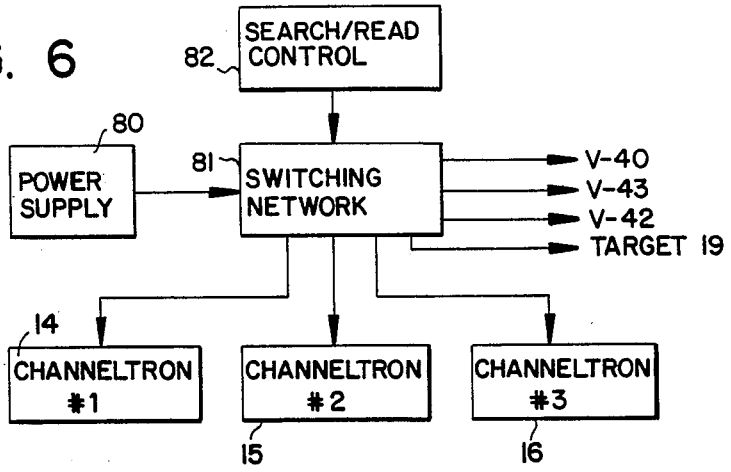
FIG. 6 is an electrical block diagram of the electrical system for energizing the spectrometer of FIG. 1.

A simplified block diagram of the electrical control system for the spectrometer is presented in FIG. 6. A power supply 80 energizes a switching network 81 receiving control signals from a "Search/Read Control" network 82. The network 81 provides the required operating voltages to the target 19, the screens 40, 42 and 43, and the channeltrons 14, 15 and 16.

In the example being described, the screen 42, closest to target 19, is biased by network 81 to a potential of approximately +660 volts and functions as a collector grid. The next electrode, screen 43, operates as a discriminator grid to reflect secondary electrons having low energy back to screen 42. During "Search" mode operation, to be described below, the voltage on screen 43 is made equal to the most positive potential at the surface of the target 19 in order to pass all secondary electrons. During "Read" mode operation, also to be described, screen 43 can be operated over a range depending upon the mean surface potential, $V_m$, of the target and whether the device is being used to ascertain the relative potential of the target surface with respect to a threshold potential, or whether the surface potential, $V_T$, at the surface of the target facing the pole piece 11 is to be ascertained, the precise potential being adjusted to achieve maximum signal contrast between electrons originating from charged and uncharged areas of the target 19.

The third electrode, screen 40, together with the pole piece 11, is intended to form a trap to keep low energy electrons in the SEM column from entering the spectrometer. The voltage on screen 40 is preferably set at $V_m-(20 \text{ to } 25)$ volts where $V_m$ is the mean surface potential of the target as noted above. The potential should be negative relative to the pole piece 11. The determining factor is avoiding appreciable defocusing of the beam.

The entrance horns 36, 37 and 38 of the continuous dynode channeltron detectors are positioned, as shown, between screen electrodes 40 and 43 and are arranged symmetrically about the axis 34 of the primary beam. Electrically, the horns 36 to 38 are the cathodes of the channeltrons and are all energized at the same potential. While the manufacturer recommends an initial landing energy of 150 eV, it has been found that in the present environment such operation does not provide optimum results. Instead, it is preferred to operate the cathodes 36 to 38 at or close to the potential of screen 43.

In order for a channeltron responding to a single incoming electron to achieve sufficient gain to produce a signal that can be detected by a following amplifier, it was found that a voltage of at least 1,800 volts must be applied to the channeltron between the anode end and the cathode entryway or mouth of the device. In the present system, the switching network 81 is constructed to apply such voltage to any combination of the three channeltrons. However, with a continuous dynode multiplier of different construction a different minimum voltage may be effective. In any case, sufficient voltage should be applied to the anode, positive relative to its cathode, to produce a detectable signal in response to a single electron entering the entryway.

It is now possible to discuss the overall operation of the spectrometer. It should be understood that the electron beam generator includes conventional means for blanking and unblanking the beam as desired. When the beam is unblanked, the electron beam passes through the scanning electron microscope electron optical column leaving the column through the central aperture in the pole piece 11. The beam then enters the spectrometer passing through apertures 41 and 50 in screen grids 40 and 43, leaving the spectrometer through a mesh opening of screen 42 which has been centered on the axis 34 of the beam. From here, the beam proceeds and primary electrons impinge on target 19. Secondary electrons, generated by the beam when it strikes the target 19, are accelerated backward toward electrode 42 by the electrostatic field which is created by the high positive voltage on screen 42 relative to the voltage at the surface of the target 19. Most of these electrons pass through screen 42. As they approach screen 43 the secondaries lose energy because of the retarding field between screen 42 at +660 volts and screen 43 at a potential close to that of the target. Those electrons having sufficient energy to overcome the retarding field will pass through screen 43 while those of lower energy will be turned around and accelerated back toward screen 42 where they will ultimately be collected. The secondary electrons which pass screen 43 are accelerated toward the entrance horn of a channeltron. This occurs because of the nature of the electrostatic field in the space formed between the channeltron cathodes 36 to 38 and the screen electrodes 40 and 43. With the channeltron cathodes energized at close to the potential of screen 43, screen 40, energized negatively with respect to screen 43, i.e., at $V_m-(20 \text{ to } 25)$ volts, will tend to repel any electrons approaching the same. In addition, with the anodes of the channeltrons energized at some relatively high positive voltage, it has been found that a positive potential field tends to extend somewhat beyond the entrances to the channeltron horns into the central area between the horns. Thus, any secondary electrons present in the space between the horns are attracted to the nearest channeltron being energized by the switching network 81 and caused to strike the inner surface of that channeltron horn. In known manner, this produces secondary electrons that are accelerated down the length of the channeltron striking the walls thereof and producing additional secondary electrons with progress towards the anodes thereof. It has been found that an electron entering the channeltron results in the production of a triangular current pulse at the channeltron anode of approximately 20 nanoseconds duration.

In order to extend the life of a channeltron it should be biased to operate at the lowest possible gain that will provide an adequate signal. The "Search/Read Control" 82 provides for this selection in operating mode. When operating in the "Read" mode the channeltrons are energized to maximize the collection efficiency of the spectrometer. This is accomplished by operating the channeltrons at high gain. However, when the system is being used to scan and locate areas on a target and to focus the electron beam generator, this system can be operated in the "Search" mode by using only a single channeltron and by operating it at reduced gain.

For a variety of reasons, both mechanical and electrical, the primary beam axis in an electron beam generator of the type described herein is not generally coincident with the mechanical axis of the beam generating column. Instead, it varies with time and depends on the particular adjustment of the beam producing and modulating components. Consequently, it is necessary to align the spectrometer and its individual control grids or screens with respect to the electron beam from time to time. This is easily accomplished with the worm gear eccentric drive for plate 13.

To summarize the operation of the system, with the electron beam energized and the usual cathode ray display (not shown) connected to the beam generator, the operator can view the screen grids 40, 42, and 43 on the viewing screen. Using the controls for positioning the plate 13, assuming that the angular position of screen 43 has been previously adjusted, alignment of the electrodes with an accuracy of ±0.001" can be accomplished in a matter of minutes. With apparatus as disclosed in the present application, satisfactory output has been obtained utilizing beam currents of less than 0.1 picoamperes. Provision of the electrode 40 operating at a negative potential relative to the mean target potential provides a shield electrode allowing the system to operate when the target surface is at a negative potential with respect to ground.

In describing the above system operation it was assumed that the pole piece of the SEM was grounded. The potentials of the three principal electrodes 40, 42 and 43, are related to the mean surface potential of the target in the manner explained above. Thus, when it is desired to use the device to determine whether or not a point on the target is at a potential above or below a predetermined threshold, screen 42 can be maintained at ($V_m$+660) volts, screen 43 at [$V_m$−(3 to 4)] volts, screen 40 at ($V_m$−20) volts, and the channeltron cathodes at the potential of screen 43, i.e., also at [$V_m$−(3 to 4)] volts. It should be understood, however, that these are suggested voltages, the actual values being variable within limits known to those skilled in the art.

When the device is to be used to measure actual surface potential, it has been found desirable to increase the negative potential of screen 40 slightly to ($V_m$−25) volts. In addition, the potential applied to screen 43 is a variable from which the potential being measured is ascertained. The voltage applied to the channeltron cathodes is caused to follow that applied to screen 43. Initially the device is calibrated by adjusting the potential of screen 43 with a known potential, $V_T$, at the target surface, the adjustment being made until a predetermined channeltron current is detected. The formula ($V_{43}-V_T$) yields a predetermined offset voltage where $V_{43}$ is the voltage applied to screen 43 and $V_T$ is the known potential. With the unknown target in place, the voltage on screen 43 is readjusted to obtain the same channeltron current. The surface potential is then given by ($V_{43}$−offset)=$V_T$.

One of the advantages in making $V_m$ negative is to permit using higher beam accelerating potentials while not increasing the primary beam energy at the target surface. This eases focusing of the primary beam while retaining the benefit of low landing energy at the target.

In the illustrated example, screen 43 is mounted in a rotatable disc 47, while the screens 40 and 42 are not similarly rotatable. However, any or all of the screens can be mounted for rotation, as desired. While an electroformed screen has been used experimentally, the invention is applicable to devices in which the screens or meshes are produced by any suitable method and can take the form of any suitable latticed structure.

As mentioned above, the channeltron cathodes are maintained at a potential that follows that of screen 43. Concommitantly, the anodes of the channeltrons are maintained sufficiently positive relative to their cathodes to produce a detectable signal in response to a single electron entering said cathode entryway. Generally this voltage is at least 1800 volts.

While two eccentrics cooperate in an orthogonal positioner in the illustrated embodiment, the "linkage" can obviously be changed. It is contemplated that any linkage that provides for planar movement along two intersecting axes could be used instead of that illustrated. This includes the possibility that the coordinate axes are located other than orthogonally, although the illustrated orthogonal embodiment is presently preferred. It should be understood, however, that other mechanical interconnections may not yield as compact and readily adjustable structure as the structure illustrated in the drawing.

Reviewing the advantages of the present invention, and particularly the facility for adjusting the plate 13 by an adjustment mechanism that extends through a vacuum lock from the exterior to the interior of the SEM housing, alignment of the spectrometer without the invention could be accomplished by observing the misalignment while the beam is on and then changing the alignment by relieving the vacuum, entering the chamber, adjusting the screens, pumping down, re-checking, and repeating reiteratively by trial and error until the desired adjustment is reached. This is a tedious and time consuming process. The advantage afforded by the present invention should be readily apparent.

The present invention makes use of two alignment structures. One provides overall alignment of the spectrometer assembly relative to the SEM. The second structure provides for alignment of screen 42 relative to screen 43. The first one, the overall alignment feature, is relative simple, has few parts, is small enough not to require an increase in working distance and achieves precise repeatability of position. In addition, the alignment can be made from outside the vacuum chamber. It was recognized that truly orthogonal motion of the spectrometer was not required and that a simpler mechanical alignment system could be used.

Regarding the alignment of screen 42 relative to screen 43, it is accomplished by a small mechanism having few parts, that maintains the plane of the screen while allowing translation in the plane, has no inherent lost motion, insulates the screen, and can be adjusted from outside the vacuum chamber.

Good discrimination and high collection efficiency is provided in the present invention by the channeltron electron multipliers. Multiple channeltrons are used, symmetrically disposed about the beam axis. The channeltrons are placed very close to screen 43 and the voltage at the horns is set very close to that of screen 43.

The use of multiple symmetrically disposed channeltrons creates a symmetrical electric field about the electron beam axis. This leads to low primary beam astigmatism. The unexpected ability of the channeltrons to detect electrons efficiently at low initial landing energies is used to achieve greater collection efficiency. It also leads to improved discrimination because the horn cathode of the channeltron can be set at the same potential as screen 43. This creates the least possible disturbance of the electric field in the vicinity of screen 43. The spot size is also better preserved by having the horns at the potential of screen 43 (usually near ground potential).

High collection efficiency, which results from the use of multiple channeltrons in the described manner, is particularly important because it permits the use of remarkably low primary beam currents (less than 0.1 picoamperes based upon actual experiment). This, in turn, is particularly advantageous when measuring insulating materials because the rate of voltage buildup on the sample is minimized. It is generally advantageous when measuring any sensitive target material, insulative or conductive, where the quantity of electron impingement must be limited.

Having described the present invention with reference to the presently preferred embodiment thereof, it will be understood that various changes in construction can be introduced by those skilled in the art without departing from the true spirit of the invention as defined in the appended claims.

What is claimed is:

1. A retarding field spectrometer in combination with a modulatable and deflectable electron beam generator which generator has a pole piece with an orifice from which said beam emanates, said spectrometer comprising in combination an array of three electron transmissable electrodes joined for mounting in the path of said beam between said pole piece and a target holder, means for individually energizing each of said electrodes with a discrete biasing voltage, means for applying a reference potential to a target in said target holder, and at least one continuous dynode electron multiplier detector of secondary electron emission comprising a cathode entryway positioned between those two of said electrodes that are situated nearest to said pole piece.

2. A retarding field spectrometer according to claim 1, wherein said continuous dynode electron multiplier comprises a channeltron having a horn cathode at its entryway which horn is positioned between said two electrodes with the mouth of said horn directed toward an at-rest axis of said beam.

3. A retarding field spectrometer according to claim 1, wherein said continuous dynode electron multiplier comprises a plurality of channeltrons each having a horn cathode at its entryway which horns are arrayed around a circle lying in a plane between and parallel to said two electrodes with the mouths of said horns directed toward the center of said circle with said center coinciding with an at-rest axis of said beam.

4. A retarding field spectrometer according to claim 3, wherein said channeltrons are three in number.

5. A retarding field spectrometer according to claim 1, wherein energizing means are coupled to said electrodes and said cathode of said continuous dynode for applying energizing electrical potential thereto, said energizing means being constructed to maintain the potential of said cathode at substantially the potential of that one of said two electrodes that is furthest from said pole piece.

6. A retarding field spectrometer according to claim 5, wherein a relative potential of a target that is mounted in said target holder is to be ascertained relative to a predetermined threshold potential, and wherein the mean potential at the surface of said target facing said pole piece is represented by $V_m$, said energizing means being constructed to maintain the potentials of said electrodes such that of said three electrodes, the electrode nearest said target is at $V_m$ plus about 660 volts, the intermediate electrode is at $V_m$ minus about 3 to 4 volts, and the electrode nearest said pole piece is at $V_m$ minus about 20 volts.

7. A retarding field spectrometer according to claim 5, wherein the surface potential, $V_T$, at the surface of said target facing said pole piece is to be ascertained, said energizing means being constructed to maintain the potentials of said electrodes such that of said three electrodes, the electrode nearest said target is at $V_m$ plus about 660 volts where $V_m$ is the mean potential at said surface of said target, the intermediate electrode is at a potential adjustable to $V_T$ plus a predeterminable known offset voltage, and the electrode nearest said pole piece is at $V_m$ minus about 25 volts.

8. A retarding field spectrometer according to claim 5, wherein said continuous dynode electron multiplier has an anode, and anode energizing means are coupled to said anode for applying energizing electrical potential thereto, said anode energizing means being constructed to maintain the potential of said anode, when energized, at a sufficient voltage positive relative to its cathode to produce a detectable signal in response to a single electron entering said entryway.

9. A retarding field spectrometer according to claim 1, wherein the one of said electrodes that is mounted for location nearest said pole piece comprises a fine mesh of electrically conductive material defining an array of small apertures with a central aperture larger in area than any of said small apertures, said central aperture being slightly larger in area than an area at the plane of said mesh that is traversed by said electron beam when the latter is deflected, and mounting means for said mesh for supporting said mesh with the plane of said mesh substantially normal to a beam at-rest axis and with said mesh position-adjustable in said plane in a manner to enable centering said central aperture about said beam at-rest axis.

10. A retarding field spectrometer according to claim 9, wherein said mounting means for said mesh comprises a mechanism for translating said mesh in a pseudo-orthogonal manner.

11. A retarding field spectrometer according to claim 10, wherein said mesh is stretched across an aperture in a mounting plate, said mounting plate has two additional apertures therethrough located, each at a distance from said central aperture, approximately 90° apart about said central aperture, one of said two additional apertures being circular while the other is in the form of a slot, and comprising two gear driven eccentrics engaged, respectively, in said two additional apertures such that rotation of the eccentric engaging said circular aperture moves said mesh along an axis paralleling said slotted aperture while rotation of the other eccentric moves said mesh in an arc centered about said circular aperture, thereby approximating orthogonal movement.

12. A retarding field spectrometer according to claim 11, wherein each of said gear driven eccentrics has operatively coupled thereto a shaft driven worm drive, and means for enabling said worm drives to be selectively engaged for actuation by a driving element engageable selectively with one or the other of said worm drives.

13. A retarding field spectrometer according to claim 1, wherein the one of said electrodes that is mounted for location nearest said target holder comprises a fine mesh of electrically conductive material defining an array of small apertures for operation as a collector grid, said collector grid being mounted on a first support member mounted for supporting said collector grid with its plane substantially normal to a beam at-rest axis and with said collector grid is position-adjustable in its said plane in a manner to enable centering one of its apertures about said beam at-rest axis.

14. A retarding field spectrometer according to claim 13, wherein the one of said electrodes that is mounted intermediate the other two electrodes comprises a fine mesh of electrically conductive material defining an array of small apertures for operation as a discriminator grid, said discriminator grid having a central aperture larger in area than any of the small apertures thereof and being mounted on a second support member for said discriminator grid with its plane substantially normal to a beam at-rest axis; said second support member being united with said first support member mounting the latter for selectable movement relative to the former.

15. A retarding field spectrometer according to claim 14, wherein said first support member is mounted on said second support member by means providing selectable orthogonal movement of said first support member relative to said second support member.

16. A retarding field spectrometer according to claim 14, wherein said discriminator grid is adjustably rotatable in its own plane relative to said second support member.

17. A retarding field spectrometer according to claim 1, wherein said three electrodes consist, respectively, of a first, second and third screen of latticed configuration of electrically conductive material, said first screen being mounted for location nearest said pole piece and having a central aperture larger in area than any of the individual meshes of said first screen, said central aperture being slightly larger in area than the area at the plane of said first screen that is traversed by said electron beam when the latter is deflected, mounting means for said first screen for supporting said first screen with the plane of said first screen substantially normal to the beam at-rest axis and with said first screen position-adjustable in said plane in a manner to enable centering said central aperture about said beam at-rest axis; said second screen being mounted for location nearest said target holder for operation as a collector grid, said collector grid being mounted on a first support member mounted for supporting said collector grid with its plane substantially normal to the beam at-rest axis and with said collector grid position-adjustable in its said plane in a manner to enable centering one of its meshes about said beam at-rest axis; and said third screen being mounted intermediate said other two screens for operation as a discriminator grid, said discriminator grid having a central aperture larger in area than any of its individual meshes and being mounted on a second support member for supporting said discriminator grid with its plane substantially normal to the beam at-rest axis, said second support member being united with said first support member mounting the latter for selectable movement relative to the former.

18. A retarding field spectrometer according to claim 17, wherein said first support member is mounted on said second support member by means providing selectable orthogonal movement of said first support member relative to said second support member.

19. A retarding field spectrometer according to claim 18, wherein said discriminator grid is adjustably rotatable in its own plane relative to said second support member.

20. A retarding field spectrometer according to claim 19, wherein said first screen is stretched across an aperture in a mounting plate, said mounting plate being provided with means for securing said mounting plate adjacent said pole piece with said first screen oriented in line with said pole piece orifice, said mounting plate securing means including means for adjustably translating said mounting plate in a pseudo-orthogonal manner for said centering of said first screen central aperture, and means joining said second support member in spaced parallel relationship to said mounting plate whereby all three screen electrodes are translated simultaneously with translation of said mounting plate.

21. A retarding field spectrometer according to claim 17, wherein said first and second support members are disposed facing each other between said collector and discriminator grids, said support members defining respective apertures in registration with the respective grid that is supported thereby, said apertures being bounded by walls in said support members which walls are configured to establish a substantially uniform field throughout the space between said collector and discriminator grids.

22. A retarding field spectrometer according to claim 21, wherein said aperture boundary walls are of conical configuration diverging radially in the axial direction toward the opposite support member.

* * * * *